US011503920B1

(12) United States Patent
Shi

(10) Patent No.: US 11,503,920 B1
(45) Date of Patent: Nov. 22, 2022

(54) DOUBLE-LAYER INFLATABLE BED

(71) Applicant: DONGGUAN HONGYU PLASTIC CO., LTD, Dongguan (CN)

(72) Inventor: Juying Shi, Dongguan (CN)

(73) Assignee: DONGGUAN HONGYU PLASTIC CO., LTD, Dongguan (CN)

( * ) Notice: Subject to any disclaimer, the term of this patent is extended or adjusted under 35 U.S.C. 154(b) by 0 days.

(21) Appl. No.: 17/651,767

(22) Filed: Feb. 18, 2022

(30) Foreign Application Priority Data

Dec. 29, 2021 (CN) ..... 202123390365.4

(51) Int. Cl.
*A47C 27/08* (2006.01)
*A47C 27/10* (2006.01)

(52) U.S. Cl.
CPC ..... *A47C 27/082* (2013.01); *A47C 27/10* (2013.01)

(58) Field of Classification Search
CPC ..... A47C 27/08; A47C 27/081; A47C 27/082; A47C 27/083; A47C 27/084; A47C 27/085; A47C 27/087; A47C 27/10
See application file for complete search history.

(56) References Cited

U.S. PATENT DOCUMENTS 7,089,618 B1 * 8/2006 Metzger ..... A47C 27/087 5/709
2003/0200610 A1 * 10/2003 Wang ..... A47C 27/10 5/710
2004/0074004 A1 * 4/2004 Boso ..... A47C 27/088 5/710
2006/0265810 A1 * 11/2006 Wu ..... A47C 27/081 5/712
2007/0245495 A1 * 10/2007 Wang ..... A47G 9/0238 5/691
2007/0283499 A1 * 12/2007 Lin ..... A47C 27/081 5/713
2011/0265267 A1 * 11/2011 Wang ..... A47C 27/081 5/722
2017/0196368 A1 * 7/2017 Liu ..... A47C 27/16
2021/0169232 A1 * 6/2021 Hou ..... A47C 27/087
2021/0259434 A1 * 8/2021 Wang ..... A47C 27/10

* cited by examiner

*Primary Examiner* — Robert G Santos
*Assistant Examiner* — George Sun
(74) *Attorney, Agent, or Firm* — Maschoff Brennan

(57) ABSTRACT

A double-layer inflatable bed includes two main layers arranged in a thickness direction of the double-layer inflatable bed, two annular peripheral layers, annular connecting layers, and two annular blocking layers. The two annular peripheral layers are connected to the two main layers respectively, the two annular peripheral layers are both connected to the annular connecting layers, and the two annular blocking layers are connected to the two main layers respectively; and ends of the two annular blocking layers away from the main layers are both connected to the annular connecting layers, wherein the two main layers and the two annular blocking layers together define a main air chamber, and the two main layers, the two annular peripheral layers, the annular connecting layers, and the two annular blocking layers together define two peripheral air chambers disposed adjacent to each other in a thickness direction of the double-layer inflatable bed.

14 Claims, 3 Drawing Sheets

DOUBLE-LAYER INFLATABLE BED

CROSS-REFERENCE TO RELATED APPLICATION

The present disclosure claims priority of Chinese patent application with the filing No. 202123390365.4 filed on Dec. 29, 2021 with the Chinese Patent Office, and entitled "Double-layer Inflatable Bed", the contents of which are incorporated herein by reference in entirety.

TECHNICAL FIELD

The present disclosure relates to the technical field of articles for daily use, and particularly to a double-layer inflatable bed.

BACKGROUND ART

The inflatable bed is a bed structure in which air can be filled to support a certain weight, and the inflatable bed has the advantages of convenient use, convenient storage, convenient transportation, and the like, and has a wide application range. That is to say, when the inflatable bed is not in use, the air in the bed body can be discharged out, and then the bed body is folded, so that the volume is small, occupying a small space and enabling quite convenient carrying. The existing inflatable beds have various structures, and the double-layer inflatable beds are more common, that is, two inflatable beds are stacked and then fixedly connected at the stacking position of the two inflatable beds.

The inventors found in researches that the existing double-layer inflatable beds have the following defects: high material consumption and high cost.

SUMMARY

An objective of the present disclosure lies in providing a double-layer inflatable bed, which can reduce the material consumption and lower the cost.

Embodiments of the present disclosure are realized as follows.

The present disclosure provides a double-layer inflatable bed, including: two main layers, two annular peripheral layers, at least one annular connecting layer, and two annular blocking layers, wherein the two main layers are arranged in a thickness direction of the double-layer inflatable bed, the two annular peripheral layers are connected to the two main layers respectively, the two annular peripheral layers are both connected to the at least one annular connecting layer, and the two annular blocking layers are connected to the two main layers, respectively; and ends of the two annular blocking layers away from the main layers are both connected to the at least one annular connecting layer; in the above, the two main layers and the two annular blocking layers together define a main air chamber, and the two main layers, the two annular peripheral layers, the at least one annular connecting layer, and the two annular blocking layers together define two peripheral air chambers disposed adjacent to each other in a thickness direction of the double-layer inflatable bed.

In an optional embodiment, in a profile of a longitudinal section of the double-layer inflatable bed, a distance between the two annular blocking layers in the thickness direction of the double-layer inflatable bed gradually increases in a direction from the outer side to the middle part of the double-layer inflatable bed, wherein the longitudinal section is a plane parallel to the thickness direction of the double-layer inflatable bed.

In an optional embodiment, an area of a cross section of the annular blocking layer increases in a direction from the main layer connected thereto to the other main layer, wherein the cross section is a plane perpendicular to the thickness direction of the double-layer inflatable bed.

In an optional embodiment, the annular peripheral layer includes a first annular body and a second annular body that are connected to each other and have an angle, the first annular body is connected to the annular connecting layer, and the second annular body is connected to the corresponding main layer; and in a profile of a longitudinal section of the double-layer inflatable bed, a distance between the two first annular bodies in the thickness direction of the double-layer inflatable bed gradually decreases in a direction from the outer side to the middle part of the double-layer inflatable bed, wherein the longitudinal section is a plane parallel to the thickness direction of the double-layer inflatable bed.

In an optional embodiment, an area of a cross section of the first annular body gradually increases in a direction from the annular connecting layer to the second annular body connected thereto, wherein the cross section is a plane perpendicular to the thickness direction of the double-layer inflatable bed.

In an optional embodiment, distances between the annular blocking layer and the annular peripheral layer which define the same peripheral air chamber are equal in the thickness direction of the inflatable bed.

In an optional embodiment, the double-layer inflatable bed further includes an air pump, the air pump is provided in one of the two peripheral air chambers; and the peripheral air chamber provided with the air pump is in communication with the main air chamber, and the main air chamber is in communication with the other peripheral air chamber.

In an optional embodiment, each of the annular peripheral layers is provided with a unidirectional inflation valve.

In an optional embodiment, the double-layer inflatable bed further includes at least one shaping member, and the shaping member is connected to both the two main layers and located in the main air chamber.

In an optional embodiment, the shaping member is provided as a pull belt.

In an optional embodiment, a plurality of shaping members are provided, and the plurality of shaping members are all provided in the main air chamber.

The beneficial effects of the embodiments of the present disclosure are as follows.

To sum up, for the double-layer inflatable bed provided in the present embodiments, by providing two annular blocking portions, the two main layers, the two annular peripheral layers, the two annular connecting layers, and the two annular blocking layers together define the two peripheral air chambers arranged adjacent to each other in the thickness direction of the double-layer inflatable bed, that is to say, a structure formed by the two peripheral air chambers may be understood as a double-layer bed structure, and the two peripheral air chambers are both annular air chambers, with no isolation layer being required to be provided in the middle part to isolate the two, thereby reducing the material consumption and lowering the cost. When the inflatable bed is in use, the main air chamber plays a main supporting role, and the two peripheral air chambers serve to enhance the structural strength of the two upper and lower bed edges of the main air chamber. When the inflatable bed is in use, an outer edge of the inflatable bed is not easy to recess, enabling high use safety, and high comfort level.

BRIEF DESCRIPTION OF DRAWINGS

In order to more clearly illustrate technical solutions of embodiments of the present disclosure, accompanying drawings which need to be used in the embodiments will be introduced below briefly, and it should be understood that the accompanying drawings below merely show some embodiments of the present disclosure, and therefore should not be considered as limitation on the scope, and a person ordinarily skilled in the art still could obtain other relevant accompanying drawings according to these accompanying drawings, without any creative effort.

REFERENCE SIGNS

Figure 1:
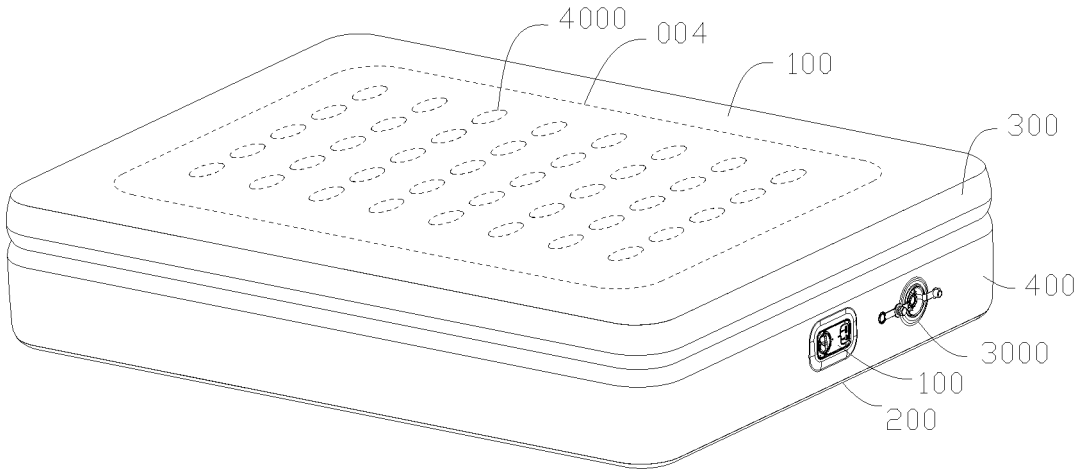
FIG. 1 is a structural schematic view of a double-layer inflatable bed of an embodiment of the present disclosure.

001-main air chamber; 002-first peripheral air chamber; 003-second peripheral air chamber; 004-first annular connecting portion; 005-second annular connecting portion; 100-first main layer; 200-second main layer; 300-first annular peripheral layer; 310-first annular body; 320-second annular body; 400-second annular peripheral layer; 410-third annular body; 420-fourth annular body; 500-first annular connecting layer; 600-second annular connecting layer; 700-first annular blocking layer; 800-second annular blocking layer; 900-air pump; 1000-first unidirectional valve; 2000-second unidirectional valve; 3000-air release valve; 4000-shaping member.

DETAILED DESCRIPTION OF EMBODIMENTS

In order to make objectives, technical solutions, and advantages of the embodiments of the present disclosure clearer, the technical solutions in the embodiments of the present disclosure will be described clearly and completely below in conjunction with the accompanying drawings in the embodiments of the present disclosure, and apparently, some but not all embodiments of the present disclosure are described. Generally, components in the embodiments of the present disclosure described and shown in the accompanying drawings herein may be arranged and designed in different configurations.

Therefore, the detailed description below of the embodiments of the present disclosure provided in the accompanying drawings is not intended to limit the scope of protection of the present disclosure, but merely represents chosen embodiments of the present disclosure. Based on the embodiments of the present disclosure, all other embodiments obtained by those ordinarily skilled in the art without any creative effort shall fall within the scope of protection of the present disclosure.

It should be noted that similar reference signs and letters represent similar items in the following accompanying drawings, therefore, once a certain item is defined in one accompanying drawing, it is not needed to be further defined or explained in subsequent accompanying drawings.

In the description of the present disclosure, it should be indicated that orientation or positional relationships indicated by terms such as "center", "upper", "lower", "left", "right", "vertical", "horizontal", "inner", and "outer" are based on orientation or positional relationships as shown in the drawings, or orientation or positional relationships of a product of the present disclosure when being conventionally placed in use, merely for facilitating describing the present disclosure and simplifying the description, rather than indicating or suggesting that related devices or elements have to be in the specific orientation or configured and operated in a specific orientation, therefore, they should not be construed as limitation to the present disclosure. Besides, terms such as "first", "second", and "third" are merely for distinguishing the description, but should not be construed as indicating or implying importance in the relativity.

Moreover, the terms "horizontal", "vertical" and the like do not mean that the parts are required to be absolutely horizontal or overhanging, but may be slightly inclined. For example, "horizontal" merely means that a structure is more horizontal in comparison with "vertical", rather than being completely horizontal, while the structure can be slightly inclined.

In the description of the present disclosure, it should be further illustrated that, unless otherwise specifically regulated and defined, the terms "set", "install", "link", and "connect" should be understood in a broad sense, for example, a connection may be a fixed connection, a detachable connection, or an integrated connection; it may be a mechanical connection or an electrical connection; it may be direct joining or indirect joining through an intermediate medium, and it also may be inner communication between two elements. For a person ordinarily skilled in the art, specific meanings of the above-mentioned terms in the present disclosure could be understood according to specific circumstances.

Currently, a double-layer inflatable bed generally includes two single inflatable beds with outer contours substantially having the same shape, and the two single inflatable beds are overlapped and fixedly connected at the overlapping place. That is to say, middle positions of the double-layer inflatable bed in the thickness direction in the prior art are isolated by two partition layers, and the outer contour of each partition layer is substantially the same as the outer contour of the double-layer inflatable bed, resulting in that the double-layer inflatable bed has large material consumption and high cost.

In view of this, the designers have designed a double-layer inflatable bed, and through reasonable structural design, the material consumption is reduced and thus the cost is lowered, on the premises of satisfying the intensity and comfort level of the double-layer inflatable bed.

Figure 2:
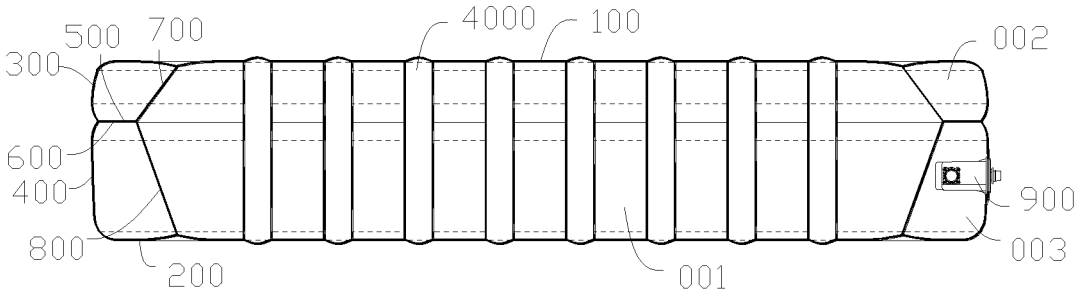
FIG. 2 is a sectional structural schematic view of the double-layer inflatable bed of an embodiment of the present disclosure.
Figure 4:
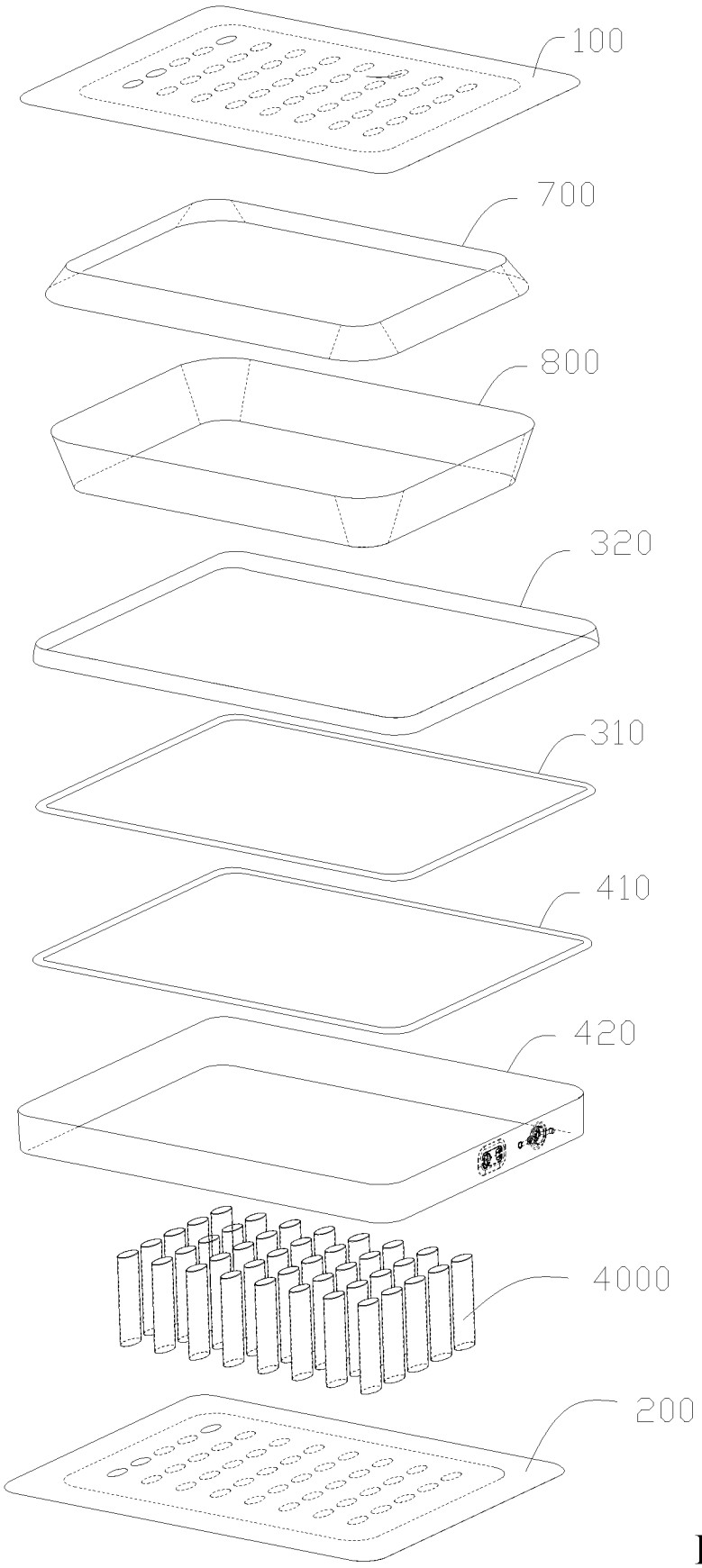
FIG. 4 is an exploded structural schematic view of the double-layer inflatable bed of an embodiment of the present disclosure.

Referring to FIG. 1, FIG. 2, and FIG. 4, in the present embodiment, the double-layer inflatable bed includes two main layers, two annular peripheral layers, two annular connecting layers, and two blocking layers. For convenience of description, the two main layers are a first main layer 100 and a second main layer 200 respectively, the two annular peripheral layers are a first annular peripheral layer 300 and a second annular peripheral layer 400 respectively, the two annular connecting layers are a first annular connecting layer 500 and the second annular connecting layer 600 respectively, and the two annular blocking layers are a first annular blocking layer 700 and a second annular blocking layer 800 respectively.

The first main layer 100 and the second main layer 200 are arranged in the thickness direction of the double-layer inflatable bed. An end of the first annular peripheral layer 300 is connected to an edge of first main layer 100, and an end of the second annular peripheral layer 400 is connected to an edge of the second main layer 200. An end of the first annular peripheral layer 300 away from the first main layer 100 is connected to an outer edge of the first annular connecting layer 500, and an end of the second annular peripheral layer 400 away from the second main layer 200 is connected to an outer edge of the second annular connecting layer 600. An end of the first annular blocking layer 700 is connected to the first main layer 100, and an end of the first annular blocking layer 700 away from the first main layer 100 is connected to an inner edge of the first annular connecting layer 500. An end of the second annular blocking layer 800 is connected to the second main layer 200, and an end of the second annular blocking layer 800 is connected to an inner edge of the second annular connecting layer 600.

Figure 3:
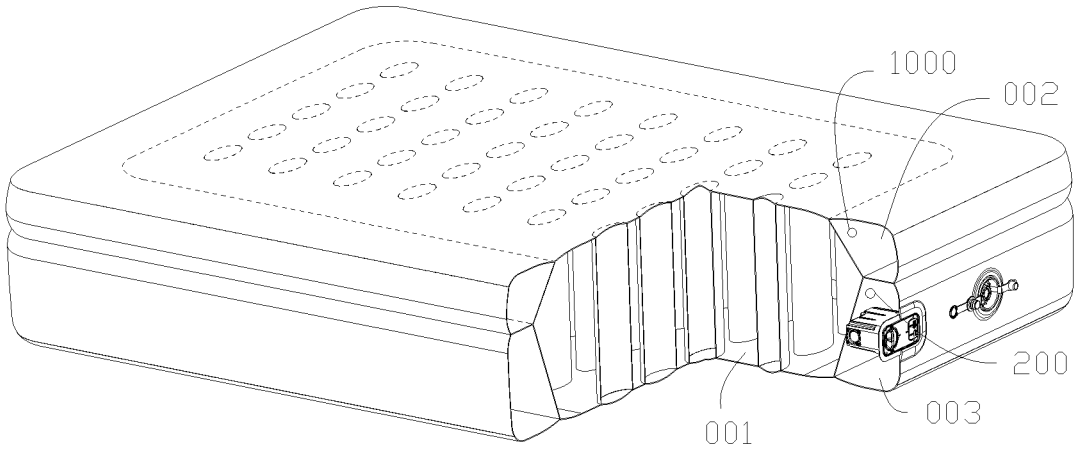
FIG. 3 is a partial sectional structural schematic view of the double-layer inflatable bed of an embodiment of the present disclosure.

Referring to FIG. 3, here, the first main layer 100, the second main layer 200, the first annular blocking layer 700, and the second annular blocking layer 800 together define a main air chamber 001; the first main layer 100, the first annular peripheral layer 300, the first annular connecting layer 500, and the first annular blocking layer 700 together define a first peripheral air chamber 002; and the second main layer 200, the second annular peripheral layer 400, the second annular connecting layer 600, and the second annular blocking layer 800 together define a second peripheral air chamber 003. The first peripheral air chamber 002 and the second peripheral air chamber 003 are disposed adjacent to each other in a thickness direction of the main air chamber 001, and after inflation, both the first peripheral air chamber 002 and the second peripheral air chamber 003 are disposed around the main air chamber 001.

It should be noted that, after the inflatable bed is inflated, the first main layer 100 and the second main layer 200 are disposed substantially directly opposite to each other. A first annular connecting portion 004 surrounding the main air chamber 001 is formed at a connecting position of the first annular blocking layer 700 and the first main layer 100 (i.e. a position where the first annular blocking layer is connected with the first main layer), wherein the first annular connecting portion 004 may be a stitching portion, a heat bonding portion or a sticking portion, that is to say, the first main layer 100 and the first annular blocking layer 700 may be fixed to each other by stitching, heat bonding or sticking, furthermore, the first annular connecting portion 004 is located in a region surrounded by an outer edge of the first main layer 100. By the same reasoning, a second annular connecting portion 005 surrounding the main air chamber 001 is formed at a connecting position of the second annular blocking layer 800 and the second main layer 200, wherein the second annular connecting portion 005 may be a stitching structure, a heat bonding structure or a sticking structure, that is to say, the second main layer 200 and the second annular blocking layer 800 may be fixed by stitching, heat bonding or sticking, furthermore, the second annular connecting portion 005 is located in a region surrounded by an outer edge of the second main layer 200.

Meanwhile, in the present embodiment, after the inflation of the inflatable bed is completed, the first annular connecting layer 500 and the second annular connecting layer 600 are substantially fitted and substantially parallel to the first main layer 100 and the second main layer 200.

It should be understood that the inflated inflatable bed may be in a quadrate shape, a circular shape, an elliptical shape and so on, wherein the quadrate shape may be a square or a rectangle. Meanwhile, both the first annular connecting layer 500 and the second connecting layer may be quadrate rings or circular rings, etc. In the present embodiment, illustration is made by taking as an example that the inflated inflatable bed is in a shape of rectangle, and both the first annular connecting layer 500 and the second annular connecting layer 600 are rectangular rings.

Referring to FIG. 4, in the present embodiment, optionally, all of the first annular blocking layer 700, the second annular blocking layer 800, the first annular peripheral layer 300, and the second annular peripheral layer 400 may be arranged as rectangular rings, so that after inflation of the inflatable bed, the first annular blocking layer 700, the second annular blocking layer 800, the first annular peripheral layer 300, and the second annular peripheral layer 400 are arranged in parallel, and all of them are perpendicular to the first main layer 100 or the second main layer 200. Meanwhile, the first annular blocking layer 700 and the second annular blocking layer 800 may be butt-jointed with each other, and the first annular peripheral layer 300 and the second annular peripheral layer 400 may be butt-jointed with each other. In this way, both the first peripheral air chamber 002 and the second peripheral air chamber 003 are rectangular annular air chambers.

Figure 5:
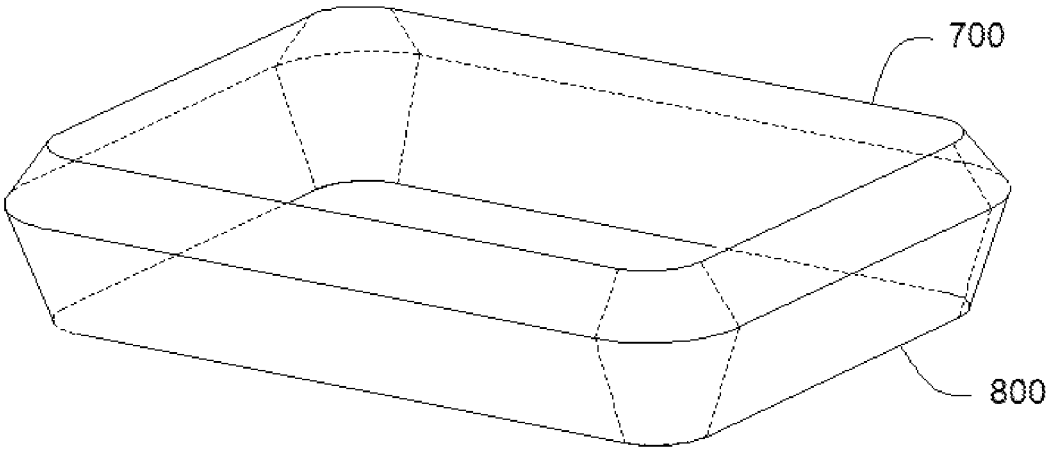
FIG. 5 is a structural schematic view of cooperation of two annular blocking layers of an embodiment of the present disclosure.

Referring to FIG. 5, in other embodiments, regions surrounded by the first annular blocking layer 700 and the second annular blocking layer 800 are both rectangular truncated pyramids, that is to say, cross section areas of the first annular blocking layer 700 and the second annular blocking layer 800 are both of a gradual change type, and longitudinal section profiles of the first annular blocking layer 700 and the second annular blocking layer 800 are both isosceles trapezoids. Specifically, an end where a first top surface of the first annular blocking layer 700 is located is connected to the first main layer 100, and an end where a first bottom surface of the first annular blocking layer 700 is located is connected to an inner edge of the first annular connecting layer 500, wherein a cross section area of the first annular blocking layer 700 gradually increases in a direction from the first top surface to the first bottom surface. By the same reasoning, an end where a second top surface of the second annular blocking layer 800 is located is connected to the second main layer 200, and an end where a second bottom surface of the second annular blocking layer 800 is located is connected to an inner edge of the second annular connecting layer 600, wherein a cross section area of the second annular blocking layer 800 gradually increases in a direction from the second top surface to the second bottom surface. Furthermore, the area of the first bottom surface and the area of the second bottom surface are substantially equal. Thus, the first annular blocking layer 700 and the second annular blocking layer 800 form a triangular-like structure, that is, in the longitudinal section profile of the double-layer inflatable bed, a distance between the first annular blocking layer 700 and the second annular blocking layer 800 in the thickness direction of the double-layer inflatable bed gradually increases in a direction from the outer side to the middle part of the double-layer inflatable bed, which can improve the stability of the overall structure. In the above, the cross section is a plane perpendicular to the thickness direction of the inflatable bed, and the longitudinal section is a plane parallel to the thickness direction of the inflatable bed. Alternatively, taking the use state of the inflatable bed as an example, the cross section is parallel to a horizontal plane, and the longitudinal section is parallel to a vertical plane.

Figure 6:
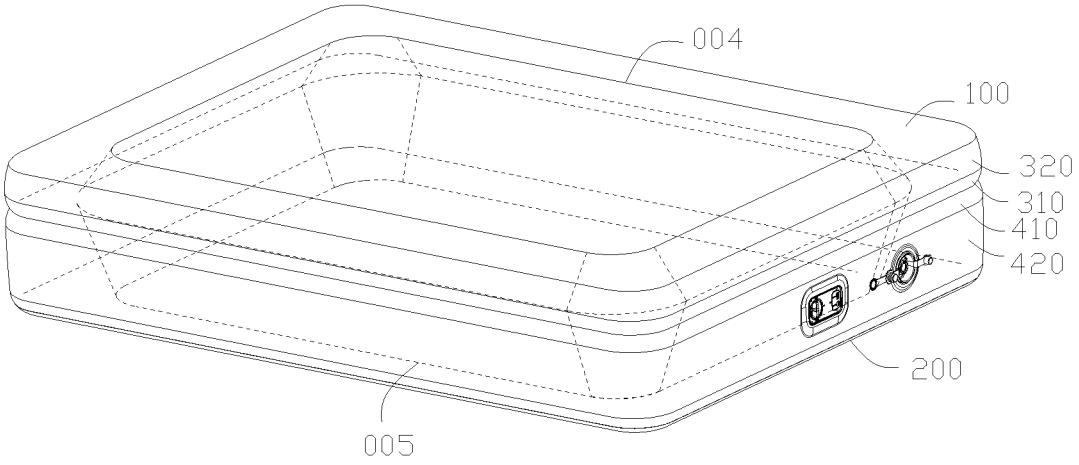
FIG. 6 is a structural schematic view of partial structure cooperation of the double-layer inflatable bed of an embodiment of the present disclosure.

Referring to FIG. 3 and FIG. 6, in other embodiments, the first annular peripheral layer 300 includes a first annular body 310 and a second annular body 320 that are connected to each other and have an angle, the first annular body 310 is a rectangular truncated pyramid, and an end of the first annular body 310 away from the second annular body 320 is connected to an outer edge of the first annular connecting layer 500. The second annular body 320 is a rectangular ring, and an end of the second annular body 320 away from the first annular body 310 is connected to the first main layer 100. The second annular peripheral layer 400 includes a third annular body 410 and a fourth annular body 420 that are connected to each other and have an angle, the third annular body 410 is a rectangular truncated pyramid, and an end of the third annular body 410 away from the fourth annular body 420 is connected to an outer edge of the second annular connecting layer 600. The fourth annular body 420 is a rectangular ring, and an end of the fourth annular body 420 away from the third annular body 410 is connected to the first main layer 100. In the longitudinal section profile of the double-layer inflatable bed, a distance between the first annular body 310 and the second annular body 320 in the thickness direction of the double-layer inflatable bed gradually decreases in a direction from the outer side to the middle part of the double-layer inflatable bed, wherein the longitudinal section is a plane parallel to the thickness direction of the double-layer inflatable bed. In this way, after the inflatable bed is inflated, a triangular-like structure is formed by the first annular body 310 and the third annular body 410, and this triangular-like structure and the triangular-like structure formed by the first annular blocking layer 700 and the second annular blocking layer 800 pull each other, and the two triangular-like structures restrict each other and together improve the stability of the double-layer inflatable bed.

It should be understood that the first annular body and the second annular body 320 may be in separate structures, and they are separately processed and then spliced together. By the same reasoning, the third annular body and the fourth annular body 420 may be in separate structures, and they are separately processed and then spliced together.

In the present embodiment, it should be noted that the first annular peripheral layer 300, the second annular peripheral layer 400, the first annular connecting layer 500, the second annular connecting layer 600, the first annular blocking layer 700, and the second annular blocking layer 800 are all four-sided annular structures. All of the first annular peripheral layer 300, the second annular peripheral layer 400, the first annular connecting layer 500, the second annular connecting layer 600, the first annular blocking layer 700, and the second annular blocking layer 800 may be in an integrated structure, and obviously, in other embodiments, all of the first annular peripheral layer 300, the second annular peripheral layer 400, the first annular connecting layer 500, the second annular connecting layer 600, the first annular blocking layer 700, and the second annular blocking layer 800 may be in separate structures. Taking the first annular peripheral layer 300 as an example, the first annular peripheral layer 300 includes four rectangular surfaces, the four rectangular surfaces are independently processed and then sequentially connected end to end to form the first annular peripheral layer 300 of a rectangular ring structure. In the present embodiment, both the integrated type and the separate type are within the scope of protection.

In other embodiments, the double-layer inflatable bed may include only the first annular connecting layer 500 or the second annular connecting layer 600, that is to say, the number of annular connecting layer may be only one, and in this case, all of the first annular blocking layer 700, the second annular blocking layer 800, the first annular peripheral layer 300, and the second annular peripheral layer 400 are connected to the same annular connecting layer, in this way, the stability of the double-layer inflatable bed can also be maintained, further reducing the material consumption, and lowering the cost.

Referring to FIG. 4, in the present embodiment, optionally, the double-layer inflatable bed further includes an air pump 900, a first unidirectional valve 1000, a second unidirectional valve 2000, an air release valve 3000, and a plurality of shaping members 4000.

In the above, the air pump 900 is provided in the first peripheral air chamber 002, and the first unidirectional valve 1000 is provided on the first annular blocking layer 700 to allow only the gas in the first peripheral air chamber 002 to flow into the main air chamber 001. The second unidirectional valve 2000 is provided on the second annular blocking layer 800 to allow only the gas in the main air chamber 001 to flow into the second peripheral air chamber 003. The air release valve 3000 is provided on the first annular peripheral layer 300. When it is required to inflate the double-layer inflatable bed, the air release valve 3000 is closed, and the air chamber is isolated from the outside. The air pump 900 is started to first inflate the first peripheral air chamber 002, and when the gas in the first peripheral air chamber 002 is sufficient and reaches an opening pressure of the first unidirectional valve 1000, the gas passes through the first unidirectional valve 1000 and enters the main air chamber 001. By the same reasoning, when the air pressure in the main air chamber 001 gradually increases and satisfies an opening pressure of the second unidirectional valve 2000, the gas gradually enters the second peripheral air chamber 003 from the main air chamber 001, until the inflation of the double-layer inflatable bed is completed. It should be understood that the air release valve 3000 may also be provided on the main air chamber 001 and the second peripheral air chamber 003, and the air release valve 3000 may be opened to perform the air release operation when not needing to use the double-layer inflatable bed.

Number of the shaping members 4000 is plural, the plurality of shaping members 4000 are all located in the main air chamber 001, and two ends of each shaping member 4000 are respectively connected to the first main layer 100 and the second main layer 200. The shaping members 4000 may be pull belts, and the shaping members 4000 may be connected to the first main layer 100 and the second main layer 200 in a stitching manner Meanwhile, the plurality of shaping members 4000 may be arranged in a rectangular array.

For the double-layer inflatable bed provided in the present embodiment, by providing two annular blocking portions, the two main layers, the two annular peripheral layers, the two annular connecting layers, and the two annular blocking layers together define the two peripheral air chambers arranged adjacent to each other in the thickness direction of the double-layer inflatable bed, that is to say, a structure formed by the two peripheral air chambers may be understood as a double-layer bed structure, and the two peripheral air chambers are both annular air chambers, with no isolation layer being required to be provided in the middle part to isolate the two, thereby reducing the material consumption and lowering the cost. When the inflatable bed is used, the main air chamber 001 plays a main supporting role, and the two peripheral air chambers serve to enhance the structural strength of the two upper and lower bed edges of the main air chamber 001. When the inflatable bed is used, an outer edge of the inflatable bed is not easily recessed, with high use safety, and high comfort level.

The above are merely for preferred embodiments of the present disclosure and not intended to limit the present disclosure. For one skilled in the art, various modifications and variations can be made to the present disclosure. Any amendments, equivalent replacements, improvements and so on made within the spirit and principle of the present disclosure should be covered within the scope of protection of the present disclosure.

What is claimed is:

1. A double-layer inflatable bed, comprising:

two main layers, two annular peripheral layers, at least one annular connecting layer, and two annular blocking layers, wherein the two main layers are arranged in a thickness direction of the double-layer inflatable bed, the two annular peripheral layers are connected to the two main layers respectively, the two annular peripheral layers are both connected to the annular connecting layer, the two annular blocking layers are connected to the two main layers respectively, and ends of the two annular blocking layers away from the main layers are both connected to the annular connecting layer, wherein the two main layers and the two annular blocking layers together define a main air chamber, and the two main layers, the two annular peripheral layers, the annular connecting layer, and the two annular blocking layers together define two peripheral air chambers disposed adjacent to each other in the thickness direction of the double-layer inflatable bed, wherein each of the annular peripheral layers comprises a first annular body and a second annular body that are connected to each other and have an angle, the first annular body is connected to the annular connecting layer, and the second annular body is connected to the corresponding main layer; and in a profile of a longitudinal section of the double-layer inflatable bed, a distance between the two first annular bodies in the thickness direction of the double-layer inflatable bed gradually decreases in a direction from an outer side to a middle part of the double-layer inflatable bed, such that the two first annular bodies form a triangular-like structure after the double-layer inflatable bed is inflated, wherein the longitudinal section is in a plane parallel to the thickness direction of the double-layer inflatable bed.

2. The double-layer inflatable bed according to claim 1, wherein in a profile of a longitudinal section of the double-layer inflatable bed, a distance between the two annular blocking layers in the thickness direction of the double-layer inflatable bed gradually increases in the direction from the outer side to the middle part of the double-layer inflatable bed, wherein the longitudinal section is a plane parallel to the thickness direction of the double-layer inflatable bed.

3. The double-layer inflatable bed according to claim 2, wherein an area of a cross section of the annular blocking layer increases in a direction from the main layer connected thereto to the other main layer, wherein the cross section is a plane perpendicular to the thickness direction of the double-layer inflatable bed.

4. The double-layer inflatable bed according to claim 1, wherein an area of a cross section of the first annular body gradually increases in a direction from the annular connecting layer to the second annular body connected thereto, wherein the cross section is a plane perpendicular to the thickness direction of the double-layer inflatable bed.

5. The double-layer inflatable bed according to claim 1, wherein distances between the annular blocking layer and the annular peripheral layer which surround the same peripheral air chamber are equal in the thickness direction of the double-layer inflatable bed.

6. The double-layer inflatable bed according to claim 1, wherein the double-layer inflatable bed further comprises an air pump, the air pump is provided in one of the two peripheral air chambers; and the peripheral air chamber provided with the air pump is in communication with the main air chamber, and the main air chamber is in communication with the other peripheral air chamber.

7. The double-layer inflatable bed according to claim 6, wherein each of the annular peripheral layers is provided with a unidirectional inflation valve.

8. The double-layer inflatable bed according to claim 1, wherein the double-layer inflatable bed further comprises at least one shaping member, and the at least one shaping member is connected to both the two main layers and located in the main air chamber.

9. The double-layer inflatable bed according to claim 8, wherein the at least one shaping member is provided as a pull belt.

10. The double-layer inflatable bed according to claim 2, wherein the double-layer inflatable bed further comprises an air pump, the air pump is provided in one of the two peripheral air chambers; and the peripheral air chamber provided with the air pump is in communication with the main air chamber, and the main air chamber is in communication with the other peripheral air chamber.

11. The double-layer inflatable bed according to claim 3, wherein the double-layer inflatable bed further comprises an air pump, the air pump is provided in one of the two peripheral air chambers; and the peripheral air chamber provided with the air pump is in communication with the main air chamber, and the main air chamber is in communication with the other peripheral air chamber.

12. The double-layer inflatable bed according to claim 8, wherein the double-layer inflatable bed further comprises an air pump, the air pump is provided in one of the two peripheral air chambers; and the peripheral air chamber provided with the air pump is in communication with the main air chamber, and the main air chamber is in communication with the other peripheral air chamber.

13. The double-layer inflatable bed according to claim 4, wherein the double-layer inflatable bed further comprises an air pump, the air pump is provided in one of the two peripheral air chambers; and the peripheral air chamber provided with the air pump is in communication with the main air chamber, and the main air chamber is in communication with the other peripheral air chamber.

14. The double-layer inflatable bed according to claim 5, wherein the double-layer inflatable bed further comprises an air pump, the air pump is provided in one of the two peripheral air chambers; and the peripheral air chamber provided with the air pump is in communication with the main air chamber, and the main air chamber is in communication with the other peripheral air chamber.

* * * * *